US006431911B2

(12) United States Patent
Pitschi

(10) Patent No.: US 6,431,911 B2
(45) Date of Patent: Aug. 13, 2002

(54) CONNECTOR FOR COAXIAL CABLES WITH THIN-WALLED OUTER CABLE CONDUCTOR

(75) Inventor: Franz Pitschi, Rottach-Egern (DE)

(73) Assignee: Spinner GmbH Elektrotechnische Fabrik, Munich (DE)

( * ) Notice: Subject to any disclaimer, the term of this patent is extended or adjusted under 35 U.S.C. 154(b) by 0 days.

(21) Appl. No.: 09/838,633

(22) Filed: Apr. 19, 2001

(30) Foreign Application Priority Data

Apr. 22, 2000 (DE) ..... 100 20 066

(51) Int. Cl.[7] ..... H01R 9/05
(52) U.S. Cl. ..... 439/583; 439/433
(58) Field of Search ..... 439/583, 578, 439/433, 585, 586, 592, 593, 877, 879

(56) References Cited

U.S. PATENT DOCUMENTS 4,271,330 A * 6/1981 Watine ..... 174/84 R
4,282,396 A * 8/1981 Watine ..... 174/84 R
4,384,404 A * 5/1983 Watine ..... 174/871
5,002,503 A * 3/1991 Campell et al. ..... 439/578
5,127,853 A * 7/1992 McMills et al. ..... 439/578
5,207,602 A * 5/1993 McMills et al. ..... 439/836
5,511,305 A * 4/1996 Garner ..... 29/828
5,609,501 A * 3/1997 McMills et al. ..... 439/578

* cited by examiner

*Primary Examiner*—Neil Abrams
*Assistant Examiner*—J. I. Duverne
(74) *Attorney, Agent, or Firm*—Henry M. Feiereisen

(57) ABSTRACT

A connector for a coaxial cable with thin-walled outer cable conductor, includes a connector head forming an outer connector conductor for electric connection to an outer cable conductor of a coaxial cable, and an inner connector conductor. Embraced by the connector head is a support insulator for retaining the inner connector conductor centrally in and spaced from the connector head, as well as a contact sleeve for establishing a contact between the outer cable conductor and the connector head. The contact sleeve has a thin-walled, cable-proximal portion formed with a thread and intended for rotation into the coaxial cable to establish the contact between the outer cable conductor and the connector head, wherein the contact sleeve has a cable-proximal end edge formed with at least one protrusion projecting in an axial direction in the direction of the cable to establish an expanding mandrel.

22 Claims, 4 Drawing Sheets

Fig.5
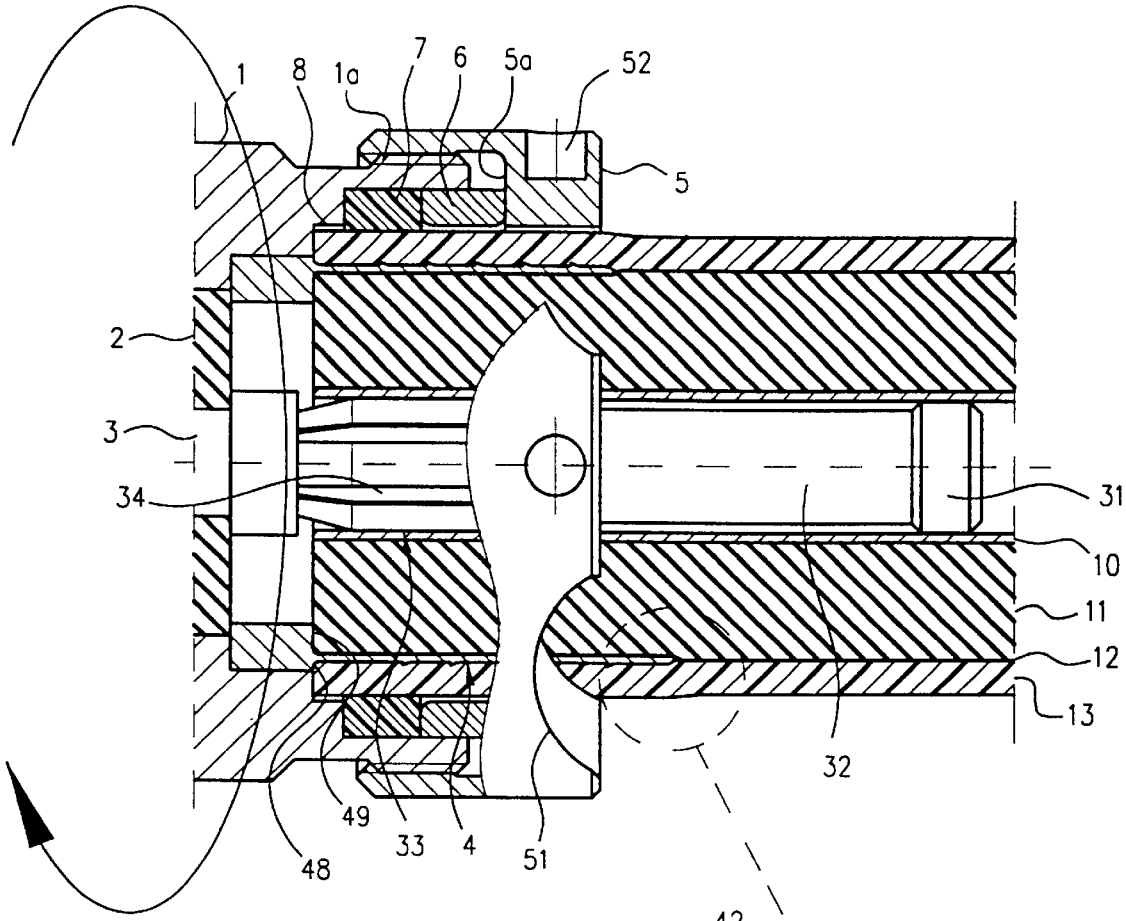
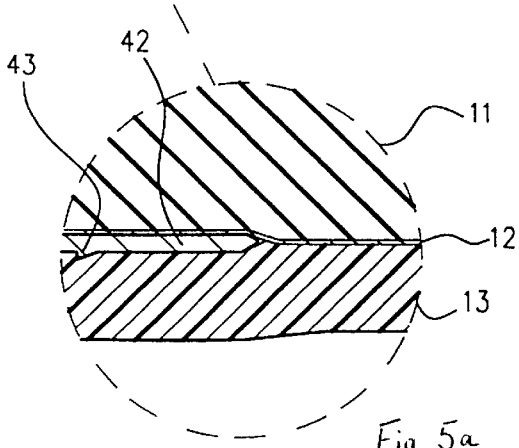
Fig. 5a

CONNECTOR FOR COAXIAL CABLES WITH THIN-WALLED OUTER CABLE CONDUCTOR

CROSS-REFERENCES TO RELATED APPLICATIONS

This application claims the priority of German Patent Application Serial No. 100 20 066.4, filed Apr. 22, 2000, the subject matter of which is incorporated herein by reference.

BACKGROUND OF THE INVENTION

The present invention relates to a connector for coaxial cables with thin-walled outer cable conductor.

Coaxial cables with thin-walled outer cable conductor are oftentimes called sheet-type cables, whereby the outer cable conductor may be made, for example, of overlapping wound copper foil or of a very thin, longitudinally welded copper tube. As so-called radiating cable, the thin and thus mechanically sensitive outer cable conductor is formed in addition with holes or openings at uniform distances. Used for these types of coaxial cables are typically connectors with a connector head that forms the outer connector conductor and embraces a support insulator for centered disposition of an inner connector conductor, as well as a contact sleeve for establishing a contact between the outer cable conductor and the connector head. The contact sleeve has a thin, cable-proximal threaded portion for rotation into the cable either between the outer cable conductor and the cable dielectric or between the cable sheath and the outer cable conductor. On the outside or inside, the contact sleeve may have a small barb.

Installation of conventional connectors of this type on respective coaxial cables is tedious as outer cable conductors typically have significant tolerances as far as diameters are concerned and oftentimes are not exactly round. As a consequence, the thin-walled outer cable conductor is pushed back or can rupture during insertion or rotation of the contact sleeve into the cable, and thus is more or less destroyed in the assembly area. A faulty contact is hereby only difficult to ascertain from outside as the cable sheath encloses the outer cable conductor.

It would therefore be desirable and advantageous to provide an improved connector which obviates prior art shortcomings and which is easy to attach to coaxial cables, also to coaxial cables with mechanically sensitive outer cable conductor that can easily be damaged, without risk of destruction of the outer cable conductor.

SUMMARY OF THE INVENTION

According to one aspect of the present invention, a connector for a coaxial cable with thin-walled outer cable conductor; includes a connector head forming an outer connector conductor for electric connection to an outer cable conductor of a coaxial cable, an inner connector conductor, a support insulator received interiorly of the connector head for holding the inner connector conductor centrally in and spaced from the connector head, a contact sleeve surrounded by the connector head for establishing a contact between the outer cable conductor and the connector head, wherein the contact sleeve has a thin-walled cable-proximal portion formed with a thread and intended for rotation into the coaxial cable for establishing the contact between the outer cable conductor and the connector head, and wherein the contact sleeve has a cable-proximal end edge formed with at least one protrusion projecting in an axial direction in the direction of the cable to establish an expanding mandrel.

During assembly, a rotation of the connector head, when the contact sleeve is in fixed rotative engagement within the connector head, or a rotation of the contact sleeve only, generates a ring-shaped gap which, depending on the diameter of the contact sleeve, may be formed either between the cable dielectric and the outer cable conductor or between the outer cable conductor and the cable sheath. The threaded portion of the contact sleeve can then be rotated completely into this forming gap, without risk of damage to the outer cable conductor. The connector includes thus an integrated expanding mandrel.

Penetration of the protruding sleeve portion, i.e. expanding mandrel, can be further facilitated when configuring the expanding mandrel with a chamfered leading edge, whereby the leading edge should, however, remain rounded and thus should not have any sharp areas.

According to another feature of the present invention, the outer thread of the thin-walled portion of the contact sleeve may be configured to commence at the cable-proximal end edge in circumferential direction approximately in vicinity of the trailing edge of the protruding sleeve portion. As a consequence, a guidance of the contact sleeve is ensured when the contact sleeve begins to penetrate the ring-shaped gap or space as created by the expanding mandrel.

According to another feature of the present invention, the cable-proximal end edge of the contact sleeve may be configured to follow a first thread turn up to the root of the leading edge. Thus, the cable-proximal end edge of the contact sleeve is not positioned in a radial plane but extends in accordance with the pitch of the thread. Also, in this way, a "blunt" penetration of the contact sleeve into the gap created by the expanding mandrel is prevented.

According to another feature of the present invention, the contact sleeve may be formed with an annular shoulder for abutment of a cable sheath of the coaxial cable. In this way, the contact sleeve and thus the entire connector have a defined position with respect to the end face of the cable after assembly. Suitably, the contact sleeve may also have an internal annular shoulder for abutment of a confronting end face of a cable dielectric.

For coaxial cables with tubular inner cable conductor, a connector according to the invention may be so configured that the inner connector conductor is extended beyond the cable-proximal end edge of the contact sleeve to provide a leading centering piece for insertion of the contact sleeve. To compensate a possible slight eccentricity of the outer cable conductor with respect to the hollow inner cable conductor, when starting to mount the connector to the cable as a result of a tilting of the outer cable conductor by hand, and thus to ensure that the expanding mandrel penetrates the cable at the intended area, the inner connector conductor may have a portion of reduced diameter disposed inwardly of the centering piece. This centering function is thus assumed by the inner connector conductor during assembly, and can be further enhanced by providing the inner connector conductor with a radially resilient contact member disposed inwardly of the centering piece.

A stable contact over an extended period even when the transition between cable and connector is exposed to mechanical stress, and a reliable protection from ingress of moisture can be realized when disposing in the recess of the connector head an elastic sealing ring and a thrust ring positioned next to the sealing ring and braced with the connector head by a clamping member so that the sealing ring is axially compressed after assembly of the connector to thereby force the cable sheath radially against the contact sleeve. The contact sleeve acts as abutment for the cable sheath which thereby, optionally together with the outer cable conductor, is clamped between the sealing ring and the wall of the contact sleeve. This construction ensures that in particular tension forces are transmitted from the cable primarily via the cable sheath to the connector and not, as is typically the case in conventional connectors, via the outer cable conductor which is extremely sensitive and thus incapable to absorb tension forces, when configured for sheet-type cables.

According to another feature of the present invention, the clamping member may be a clamping bush having at least one recess for allowing visual inspection of the expanding mandrel of the contact sleeve, when the clamping bush occupies a predetermined rotation position with respect to the connector head.

BRIEF DESCRIPTION OF THE DRAWING

Other features and advantages of the present invention will be more readily apparent upon reading the following description of preferred exemplified embodiments of the invention with reference to the accompanying drawing, in which:

FIG. 4 is a longitudinal section of the connector of FIG. 1 after completed attachment onto the coaxial cable;

FIG. 5 is a longitudinal section of another embodiment of a connector according to the present invention after attachment onto a cable; and FIG. 5*a* is a cutaway section, on an enlarged scale, of a contact region between the contact sleeve and the outer cable conductor.

DETAILED DESCRIPTION OF PREFERRED EMBODIMENTS

Figure 1:
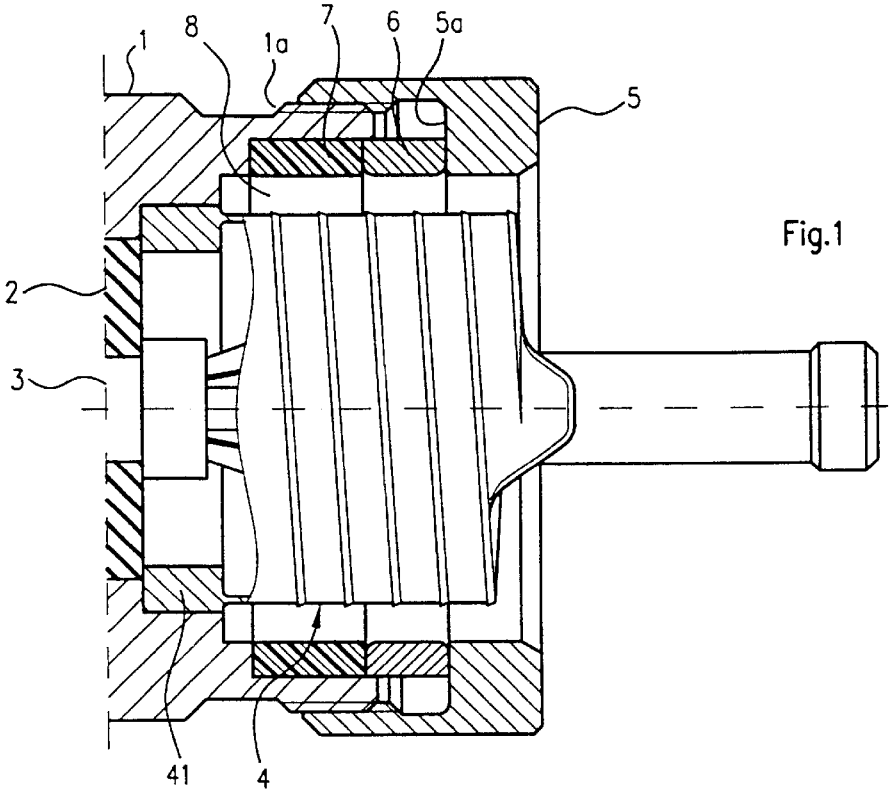
FIG. 1 is a longitudinal section of one embodiment of a connector according to the present invention for attachment onto a coaxial cable.

Throughout all the Figures, same or corresponding elements are generally indicated by same reference numerals.

Turning now to the drawing, and in particular to FIG. 1, there is shown a longitudinal section of one embodiment of a connector according to the present invention for attachment onto a coaxial cable. The connector includes a connector head 1 which forms the outer connector conductor and embraces a support insulator 2 for centered positioning of an inner connector conductor 3, and a contact sleeve 4. The connector head 1 has an outer threaded section 1*a* for threaded attachment of a clamping bush 5 which is formed with an inturned ring collar 5*a* for abutment against a thrust ring 6 of metal which rests against a confronting end face of a sealing ring 7. With its other end face, the sealing ring 7 is supported by the bottom of a recess 8 of the connector head 1.

In the description, the term "cable-proximal" or "cable-proximal side" will denote a location of those portions of the connector which are directed closer to the right of FIGS. 1 to 5, i.e. to the location of the coaxial cable, while the term "cable-distal" or cable-distal side" will denote the opposite location.

The contact sleeve 4 is seated in fixed rotative engagement in the recess 8 of the connector head 1. In the non-limiting example of FIG. 1, the fixed rotative engagement between the contact sleeve 4 and the connector head 1 is realized through press-fitting a thick-walled, cable-distal fitting member 41 of the contact sleeve 4 in a complementary seat in the recess 8. In this way, the connector can be pre-fabricated ready for assembly, unlike connectors that are composed of several single components that are mounted in sequence onto the cable. Of course, the contact sleeve 4 may also be formed as separate component, whereby a fixed rotative engagement with the connector head 1 may then be realized by a tongue and groove joint, for example by providing a short axial groove in the inside wall surface of the connector head 1 in the area of the recess 8 and a complementary rib on the contact sleeve 4.

Figure 2:
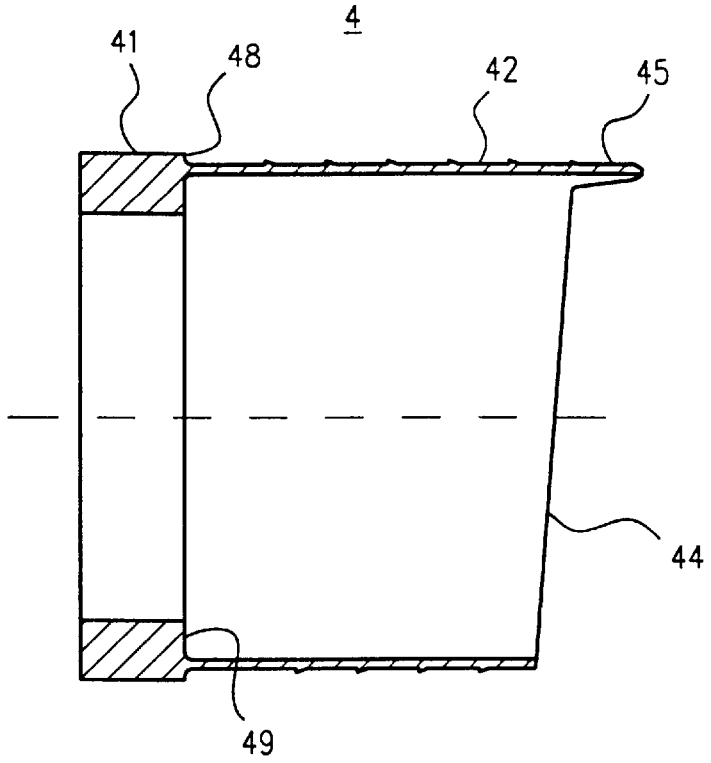
FIG. 2 is a longitudinal section of a contact sleeve of the connector of FIG. 1.
Figure 2A:
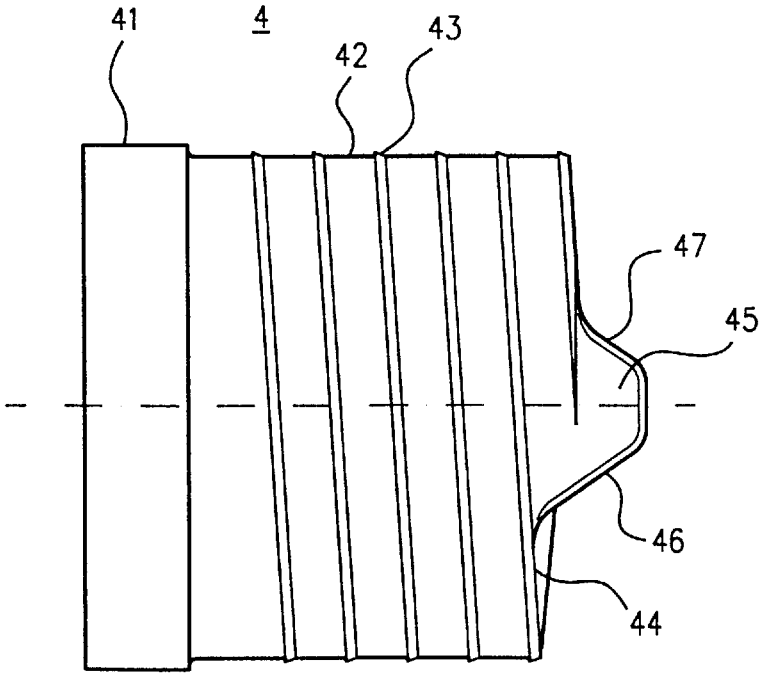
FIG. 2*a* is a side view of the contact sleeve of FIG. 2.

Turning now to FIG. 2, there is shown a longitudinal section of the contact sleeve 4, and to FIG. 2*a* which shows a 900 rotated side view of the contact sleeve 4. Accordingly, the contact sleeve 4 includes a thin-walled portion 42 which is connected to the fitting member 41 and formed with a coarse outer thread 43, preferably with saw-tooth like profile. On its cable-proximal side, the thin-walled portion 42 has an end edge 44 which is formed with a protrusion projecting in axial direction toward the cable to provide an expanding mandrel 45. As viewed in rotating direction of the connector into the cable, the expanding mandrel 45 has a leading edge 46 and a trailing edge 47. The leading edge 46 is chamfered and connects at its root with the end edge 44.

As shown in particular in FIG. 2*a*, the leading edge 46 is followed by the first turn of the thread 43 which commences in circumferential direction approximately in proximity of the trailing edge 47 of the expanding mandrel 45.

Although not shown in the drawing, it will be appreciated by persons skilled in the art, that the connector may, of course, be provided with more than one expanding mandrel, whereby in this case, the single thread is suitably replaced by a multiple thread.

Figure 3:
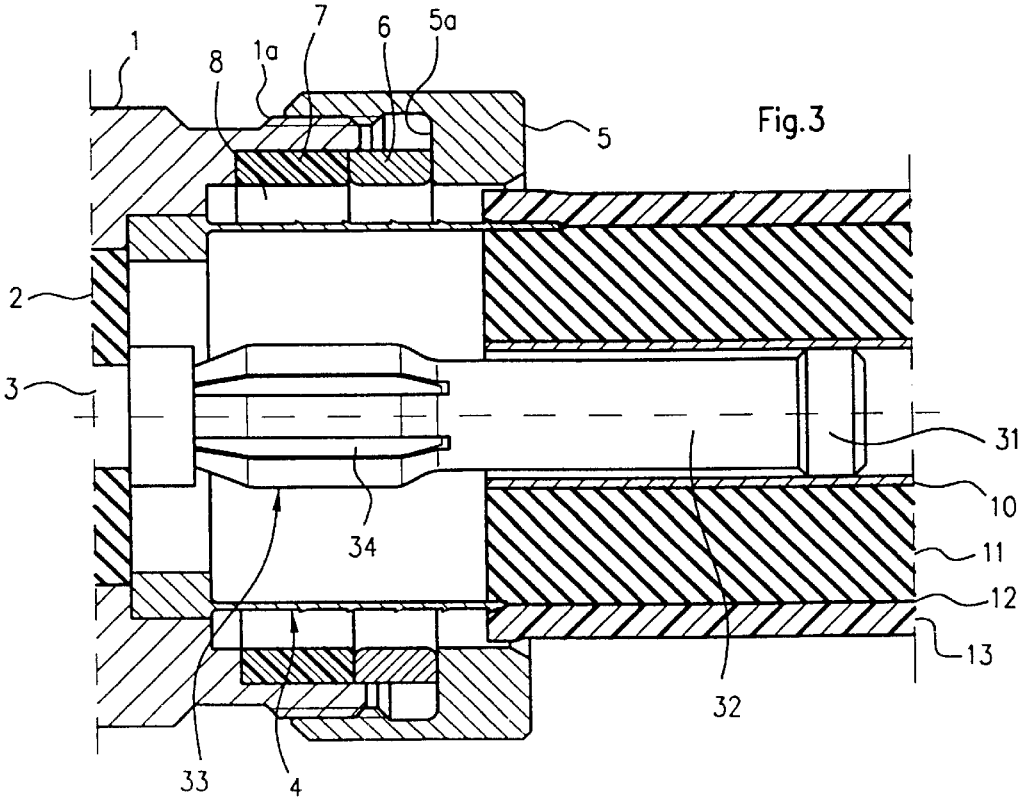
FIG. 3 is a longitudinal section of the connector of FIG. 1 at an initial phase of attachment onto the coaxial cable.

Turning now to FIG. 3, there is shown a longitudinal section of the connector of FIG. 1 at an initial phase of attachment onto the coaxial cable with a tubular inner cable conductor 10, which is centered in and supported by a dielectric 11 normally made of foamed material. Surrounding the dielectric 11 is a thin-walled outer conductor 12 which may be made, for example, of a copper foil, and is enclosed by a cable sheath 13 of plastic material. The contact sleeve 4 has hereby a diameter sufficient to penetrate between the outer cable conductor 12 and the dielectric 11.

Assembly can be facilitated by configuring the inner connector conductor 3 of a length sufficient to extend beyond the end edge 44 of the contact sleeve 4, whereby the inner connector conductor 3 has a cable-proximal end formed with a centering collar 31 which matches the interior diameter of the inner cable conductor 10. Extending inwardly of the centering collar 31, the inner connector conductor 3 has a portion 32 of slightly reduced diameter to allow insertion even when the outer cable conductor 12 is slightly eccentric with respect to the inner cable conductor 10. In order to ensure a reliable contact between the inner cable conductor 10 and the inner connector conductor 3, the inner connector conductor 3 has a cable-distal end zone to form a beaded end 33 provided with a plurality of axial slots 34 to define a plurality of radially elastic segments which, during preceding production of the inner connector conductor 3, are axially upset to effect a radial expansion, as shown in FIG. 3.

Figure 4A:
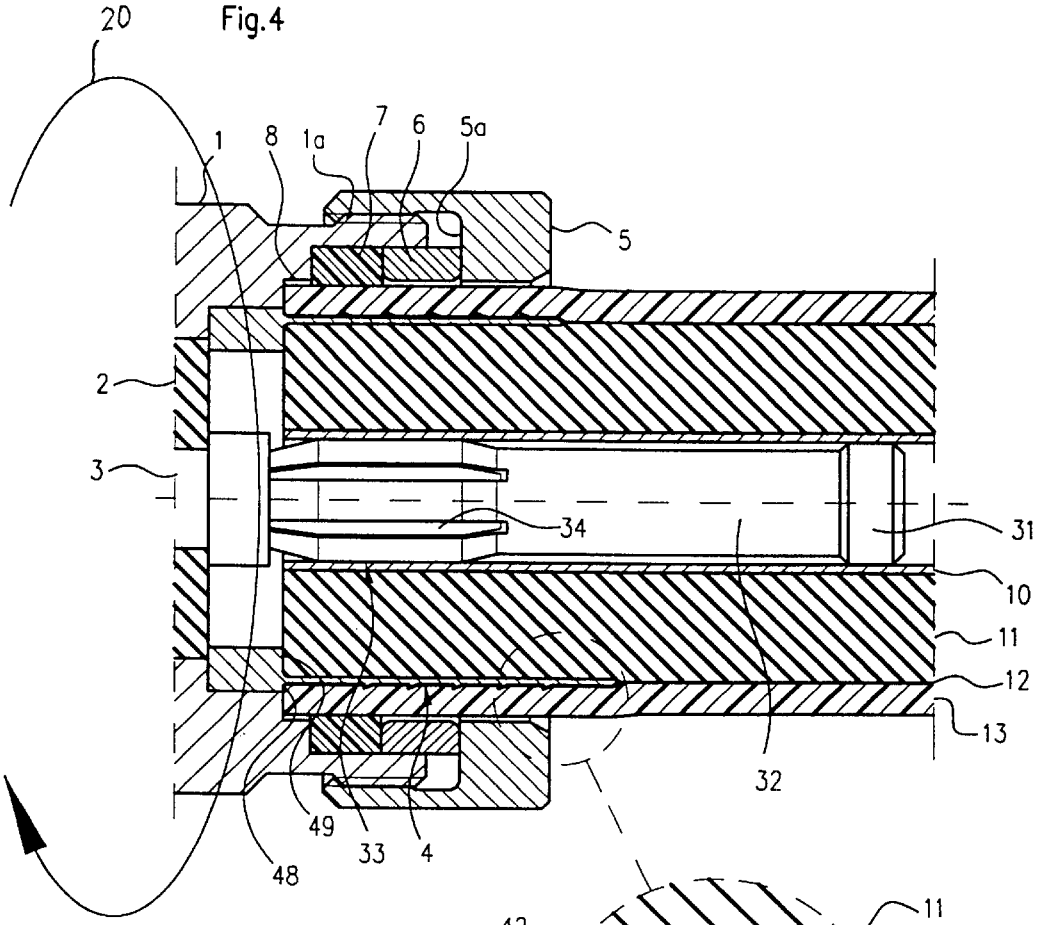
FIG. 4*a* is a cutaway section, on an enlarged scale, of a contact region between the contact sleeve and the outer cable conductor.
Figure 4A:
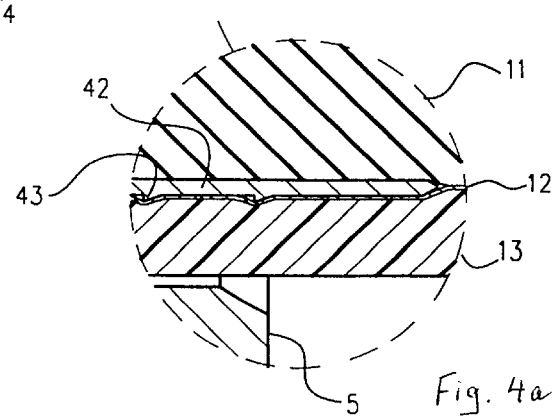

As a consequence of the course of the thread 43 of the contact sleeve 4, the rotation direction of the connector for attachment onto the cable is established, as shown by arrow 20 in FIG. 4. The rotation of the connector into the cable is continued until reaching the assembly position, shown in FIG. 4, in which the cable sheath 13 rests against an external annular shoulder 48 of the contact sleeve 4 and the dielectric 11 rests against an inner annular shoulder 49 of the contact sleeve 4. Annular shoulders 48, 49 can also be seen in the illustration of FIG. 2. Subsequently, the clamping bush 5 is attached to the connector head 1 so that the metal ring 6 axially compresses the sealing ring 7. As a result, the inner diameter of the sealing ring 7 is reduced and the sealing ring 7 is able to clamp the cable sheath 13 inside the connector head 1, whereby the cable sheath 13 is urged on the inside against the contact sleeve 4. In this way, ingress of moisture into the contact area between the connector and the cable is reliably prevented and the cable is mechanically captured which in case of sheet-type cables is realized practically exclusively by the cable sheath 13 to prevent exposure of the thin outer cable conductor 12 to tension forces.

FIG. 4*a* shows in more detail the position of the portion 42 of the contact sleeve 4 upon penetration into the coaxial cable between the dielectric 11 and the outer cable conductor 12 in which the thread 43 digs in.

Turning now to FIG. 5, there is shown a longitudinal section of another embodiment of a connector according to the present invention. Parts corresponding with those in FIG. 1 are denoted by identical reference numerals and not explained again. In this embodiment, the diameter of the contact sleeve 4 is so sized that the cable-proximal portion 42 penetrates between the outer cable conductor 12 and the cable sheath 13, as shown in greater detail in FIG. 5*a*. In this case, the thread 43 digs into the cable sheath 13. This improves the transfer of tension forces, acting on the cable, to the connector. In the embodiment of FIG. 5, the clamping bush 5, shown here by way of a partial section, has at least one recess 51 which is so positioned in the pre-assembly stage as to clear a viewing lane for an installer to see the expanding mandrel 45 of the contact sleeve 4. Thus, the installer is able to check whether or not the expanding mandrel 45 is correctly positioned on the cable, in this case between the outer cable conductor 12 and the cable sheath 13, or between the outer cable conductor 12 and the dielectric 11, in case of the embodiment shown in FIG. 4. The clamping bush 5 is further provided about its perimeter with a plurality of radial blind bores 52 for attachment of a hook wrench when the connector is configured with greater diameter.

While the invention has been illustrated and described as embodied in a connector for coaxial cables with thin-walled outer cable conductor, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A connector for a coaxial cable with thin-walled outer cable conductor, comprising:

a connector head forming an outer connector conductor for electric connection to an outer cable conductor of a coaxial cable;

an inner connector conductor;

a support insulator received interiorly of the connector head for retaining the inner connector conductor centrally in and spaced from the connector head;

a contact sleeve, surrounded by the connector head and rigid in radial direction, for establishing a contact between the outer cable conductor and the connector head, wherein the contact sleeve has a thin-walled, cable-proximal portion formed with a thread and intended for rotation into the coaxial cable to establish the contact between the outer cable conductor and the connector head, and wherein the contact sleeve has a cable-proximal end edge formed with at least one protrusion projecting in an axial direction in the direction of the cable to establish an expanding mandrel.

2. The connector of claim 1, wherein the expanding mandrel has a leading edge and a trailing edge as viewed in rotating direction of the contact sleeve into the cable, wherein at least the leading edge is chamfered.

3. The connector of claim 2, wherein the thread on the thin-walled portion of the contact sleeve is configured to commence at the cable-proximal end edge in circumferential direction approximately in vicinity of the trailing edge of the expanding mandrel.

4. The connector of claim 3, wherein the leading edge of the expanding mandrel is defined by a base, wherein the cable-proximal end edge of the contact sleeve is configured to follow a first turn of the thread up to the base of the leading edge.

5. The connector of claim 1, wherein the contact sleeve has a cable-proximal outer annular shoulder for abutment of a cable sheath of the coaxial cable.

6. The connector of claim 1, wherein the contact sleeve has a cable-proximal inner annular shoulder for abutment of a confronting end face of a cable dielectric.

7. The connector of claim 1 with the coaxial cable having a tubular inner cable conductor, wherein the inner connector conductor extends beyond the cable-proximal end edge of the contact sleeve to provide a leading centering piece for insertion of the contact sleeve.

8. The connector of claim 7, wherein the inner connector conductor has a portion of reduced diameter disposed inwardly of the centering piece.

9. The connector of claim 7, wherein the inner connector conductor has a radially resilient contact member disposed inwardly of the centering piece.

10. The connector of claim 1, with the coaxial cable having a cable sheath, wherein the connector head has a recess, and further comprising a sealing ring received in the recess, a thrust ring positioned outwardly next to the sealing ring, and a clamping member for bracing the thrust ring with the connector head so that the sealing ring is axially compressed to radially urge the cable sheath upon the contact sleeve, after assembly of the connector onto the coaxial cable.

11. The connector of claim 10, wherein the clamping member is a clamping bush having at least one recess for allowing visual inspection of the expanding mandrel of the contact sleeve when the clamping bush occupies a predetermined rotation position with respect to the connector head.

12. A connector adapted for attachment to a coaxial cable, comprising:

a connector head; and a contact sleeve placed interiorly of and electrically connected to the connector head, for establishing a contact between an outer conductor of a coaxial cable and the connector head, wherein the contact sleeve has a substantially cylindrical portion and is rigid in radial direction, said contact sleeve being formed with a thread and terminating in a threadless protrusion configured for piloting the cylindrical portion of the contact sleeve, when the contact sleeve is rotated into the coaxial cable.

13. The connector of claim 12, wherein the protrusion has a leading edge and a trailing edge as viewed in rotating direction of the contact sleeve into the coaxial; cable, wherein at least the leading edge is chamfered.

14. The connector of claim 13, wherein the thread on the cylindrical portion of the contact sleeve is configured to commence at an end edge of the cylindrical portion approximately in vicinity of a trailing edge of the protrusion.

15. The connector of claim 13, wherein the leading edge of the protrusion is defined by a base, wherein the end edge of the cylindrical portion is configured to follow a first turn of the thread up to the base of the leading edge.

16. The connector of claim 12, wherein the contact sleeve has a first annular shoulder for abutment of a cable sheath of the coaxial cable.

17. The connector of claim 12, wherein the contact sleeve has a second annular shoulder for abutment of a confronting end face of a dielectric of the coaxial cable.

18. The connector of claim 12, and further comprising an inner connector conductor extending beyond an end face of the contact sleeve to form a leading centering piece.

19. The connector of claim 18, wherein the inner connector conductor has a portion of reduced diameter disposed inwardly of the centering piece.

20. The connector of claim 18, wherein the inner connector conductor has a radially resilient contact member disposed inwardly of the centering piece.

21. The connector of claim 12, wherein the connector head has a recess, and further comprising a sealing ring received in the recess, a thrust ring positioned outwardly next to the sealing ring, and a clamping member for bracing the thrust ring with the connector head so that the sealing ring is axially compressed to thereby apply a radial force upon the contact sleeve, after assembly of the connector onto the coaxial cable.

22. The connector of claim 21, wherein the clamping member is a clamping bush having at least one recess for allowing a visual inspection of a position of the contact sleeve.

* * * * *